US006289863B1

(12) United States Patent
Hada et al.

(10) Patent No.: US 6,289,863 B1
(45) Date of Patent: Sep. 18, 2001

(54) INTAKE MANIFOLD

(75) Inventors: Masatoshi Hada, Nagoya; Yasuo Sunaga, Koga, both of (JP)

(73) Assignees: Aichi Kikai Kogyo Kabushiki Kaisha, Nagoya; Sanoh Kogyo Kabushiki Kaisha, Koga, both of (JP)

( * ) Notice: Subject to any disclaimer, the term of this patent is extended or adjusted under 35 U.S.C. 154(b) by 0 days.

(21) Appl. No.: 09/472,237

(22) Filed: Dec. 27, 1999

(30) Foreign Application Priority Data

Dec. 25, 1998 (JP) ..... 10-376884
Jun. 21, 1999 (JP) ..... 11-174167

(51) Int. Cl.[7] ..... F02M 35/104
(52) U.S. Cl. ..... 123/184.47
(58) Field of Search ..... 29/890.08; 228/136; 123/184.61, 184.21, 184.24, 184.34, 184.42, 184.47

(56) References Cited

U.S. PATENT DOCUMENTS 4,829,944 * 5/1989 Sukimoto et al. ..... 123/184.61
5,253,616 10/1993 Voss .
5,357,931 10/1994 Semence .
5,400,951 3/1995 Shiroyama et al. .
5,404,632 * 4/1995 Zaborszki ..... 29/508
5,762,036 * 6/1998 Verkleeren ..... 123/184.56
5,954,021 * 9/1999 Yuunaga ..... 123/184.42

FOREIGN PATENT DOCUMENTS 4350353 12/1992 (JP) .
08004609 1/1996 (JP) .

* cited by examiner

*Primary Examiner*—Tony M. Argenbright
*Assistant Examiner*—Hyder Ali
(74) *Attorney, Agent, or Firm*—Dennison, Scheiner, Schultz & Wakeman

(57) ABSTRACT

An intake manifold has a plurality of branch tubes each joined by brazing in a furnace at one end to a flange on the engine side and at the other end to a surge tank on the throttle chamber side. The surge tank is separated into two pieces or a brazing side member and a non-heating side member. Branch tubes are fixed in position relative to the brazing side member by peen locking with a peening tool or the like and are then joined to the brazing side member by brazing in the furnace. The non-heating side member is not subjected to the brazing in the furnace but is joined to the brazing side member by bolts or the like.

4 Claims, 4 Drawing Sheets

INTAKE MANIFOLD

BACKGROUND OF THE INVENTION

1. Field of the Invention

The present invention relates to an intake manifold for use with an automobile gasoline engine or an automobile diesel engine.

2. Description of the Related Art

In common, an intake manifold for use with a gasoline engine for an automotive vehicle is provided, as shown in a schematic view of FIG. 5, in which a plurality of branch tubes 53 are connected at one end to a flange 51 joined to an intake port of the engine and at the other end to a surge tank 52 joined to a throttle chamber. As the assembly including the branch tubes 53 and the surge tank 52 is generally formed by metal casting, the freedom for designing the passage of the branch tubes 53 is lowered due to various limitations of the casting such as the separation of molds. Also, the distribution of molten metal requires a considerable thickness of casting, hence increasing the overall weight of a casting. For the purpose of eliminating such a problem, an intake manifold is disclosed in Japanese Patent Laid-open Publication (Hei)4-350353 in which the branch tubes 53 are fabricated by bending and joining by brazing in a furnace a set of aluminum alloy pipes at both ends to the flange 51 and the surge tank 52 of aluminum casting.

The joining the branch tubes 53 to the flange 51 and the surge tank 52 by brazing in a furnace provides high air-tightness at the joints thus allowing the mass production. However, the joining by brazing in a furnace where they are heated up under a high-temperature atmosphere with a brazing material being melted may cause thermal deformation due to a difference in the thermal capacity between the two materials to be joined. For example, as shown in an enlarged cross sectional view of FIG. 6, the branch tubes 53 are dislocated from their correct position to the brazing region 54 of the surface tank 52 and may decline their function. Also, as the assembly is placed under such a high-temperature atmosphere in the furnace, the branch tubes 53 of aluminum alloy and the surge tank 52 of aluminum casting are possibly annealed hence decreasing the physical strength. Particularly in case that the joint portion is formed with threaded holes for tightening stays and brackets by means of screws, the physical strength of the joint portion will significantly be declined.

SUMMARY OF THE INVENTION

It is an object of the present invention in view of the foregoing problem to provide an improved intake manifold which can be made of an aluminum material and which can maintain a significant degree of air-tightness by brazing in a furnace, while eliminating adverse effects of deformation by heat, preventing positional discrepancy, and ensuring the mounting strength of a reinforcement member if the reinforcement member is to be mounted.

Therefore, according to the present invention, there is provided an intake manifold which has a plurality of branch tubes each joined by brazing in a furnace at one end to a flange on an engine side and at the other end to a surge tank on a throttle chamber side. The surge tank is separated into two pieces or a brazing side member and a non-heating side member. Branch tubes are fixed in position to the brazing side member by peen locking with a peening tool or the like and are then joined by brazing in the furnace. The non-heating side member is not subjected to the brazing in the furnace but is joined to the brazing side member by fasteners such as bolts or the like.

Because the surge tank is separated into two pieces, the peening tool can be set into the brazing side member so as to fix the brazing side member and the branch tubes to each other at a predetermined joining position by peen locking. The joined parts are then subjected to the brazing in the furnace. Accordingly, the joining operation can accurately be made without causing any positional discrepancy while providing a significant degree of air-tightness. Also, because of the separation into two pieces, a common, low cost aluminum casting method can be employed with no use of cores. Moreover, the non-heating side member can be fabricated of a low-melting point aluminum alloy which is available at lower cost The non-heating side member may be reinforced by a reinforcement member such as a stay. Since then on-heating side member of the surge tank remains outside the furnace and is not declined in the physical strength, it can be provided with a female thread or the like by means of which the reinforcement member such as a stay can be mounted for rigidly supporting the entirety of the surge tank.

DETAILED DESCRIPTION OF THE PREFERRED EMBODIMENTS

Embodiments of the present invention will now be described referring to the accompanying drawings.

Figure 1:
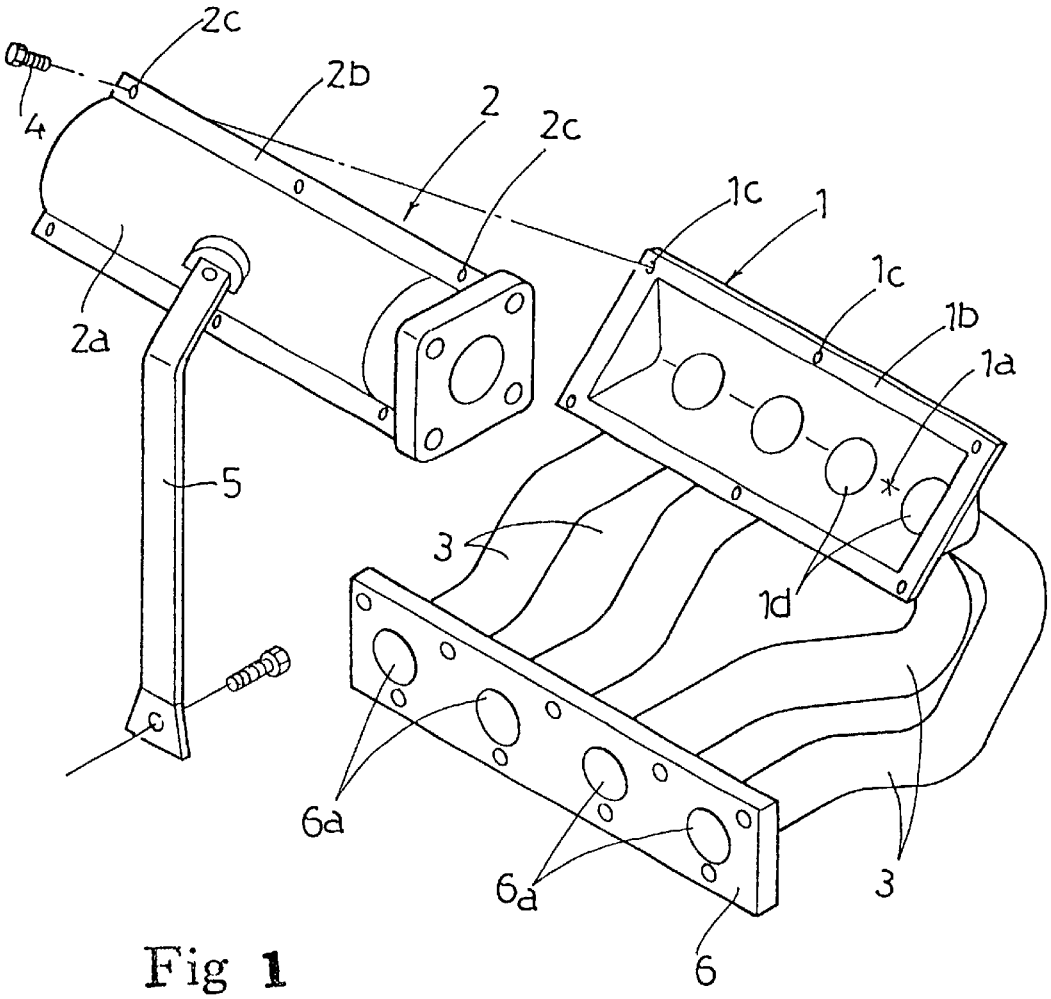
FIG. 1 is an exploded perspective view of an intake manifold according to a first embodiment of the present invention.

FIG. 1 is a schematic exploded view of an intake manifold that has a surge tank joined to a throttle chamber (not shown). The intake manifold is separated into two pieces or a brazing side member 1 and a non-heating side member 2. The brazing side member 1 is formed of, for example, aluminum alloy casting having a high melting point. The brazing side member 1 has an inner wall portion 1*a* and an outer edge portion 1*b*. The outer edge portion 1*b* is disposed about the inner wall portion 1*a* and is provided with bolt holes 1*c*. Four openings 1*d* are formed in the inner wall portion 1*a* and are arranged at equal intervals. As shown in an enlarged cross sectional view of FIG. 2, a projection 1*e* is formed about each opening 1*d* and is integral with the outer side of the inner wall portion 1*a*. Branch tubes 3 are made of aluminum pipes. Each of the branch tubes 3 is inserted at one end from the outside into the opening 1*d* and is then peen-locked to the projection 1*e* by forcibly inserting a peening tool K into the branch tube 3, so that each of the branch tubes 3 can be fixed accurately in a predetermined position. Thus, the peening tool K serves to forcibly expand each of the branch tubes 3 so as to be press-fitted against the projection 1*e*. In this state, the brazing side member 1 is placed in a furnace so as to braze the one end of each branch tube 3 and the projection 1*e* to each other. Because the branch tubes 3 are reliably held in position by the peen-locking operation, the brazing operation is carried out with a uniform clearance between each two adjacent brazing portions and with a uniform brazing length of the brazing portions. Accordingly, the brazing operation in the furnace can offer a higher degree of air-tightness without any positional discrepancy.

Figure 2:
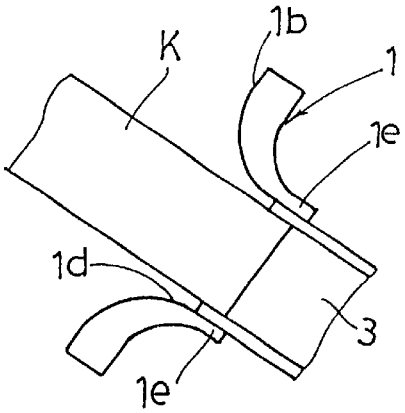
FIG. 2 is an enlarged cross sectional view showing the brazing area where a branch tube is positioned by peen locking to the brazing side member of a surge tank.

The other end of each branch tube 3 can be joined to a flange 6, which is connected to an intake port (not shown), can be made in the same manner as the arrangement shown in FIG. 2. Thus, the peen-locking operation using the peening tool K is first made to determine the brazing position, and the brazing operation in the furnace is then carried out to provide a reliable air-tightness.

The non-heating side member 2 of the surge tank is formed by casting, for example. of an aluminum alloy having a low melting point. The non-heating side member 2 has an inner wall 2*a* and an outer edge portion 2*b*. The outer edge portion 2*b* is provided with bolt holes 2*c* and is formed integrally with the inner wall 2*a*. The inner wall 2*a* is adapted to be positioned opposite to the inner wall 1*a* of the brazing side member 1. With the bolt holes 2*c* of the non-heating side member 2 placed in alignment with the bolts holes 1*c* of the brazing side member 1. a bolt 4 is inserted into each of the holes 1*c* and the corresponding hole 2*c* and is then tightened to securely lock the non-heating side member 2 to the brazing side member 1. As a result, the surge tank is completed and may have a shape that is identical with the conventional ones. The non-heating side member 2 requires no brazing process in a furnace and therefore is not heated in the furnace, hence maintaining its physical strength. This will allow a reinforcement member or a stay 5 to be tightened to the non-heating side member 2 by means of a bolt that is screwed into its corresponding female thread provided in the non-heating side member 2.

Since the brazing side member 1 and the non-heating side member 2 are separated from each other, they can be fabricated by aluminum casting at lower cost without use of cores. In addition, the brazing side member 1 is low in the thermal capacity since it is separated. Thus, any positional discrepancy between the brazing side member 1 and the branch tubes 3 can be eliminated during the joining by brazing of the branch tubes 3 to the brazing side member 1. Moreover, because the positioning operation in this embodiment is assisted by the peen-locking with the peening tool K, the positional discrepancy may reliably be eliminated.

Figure 3:
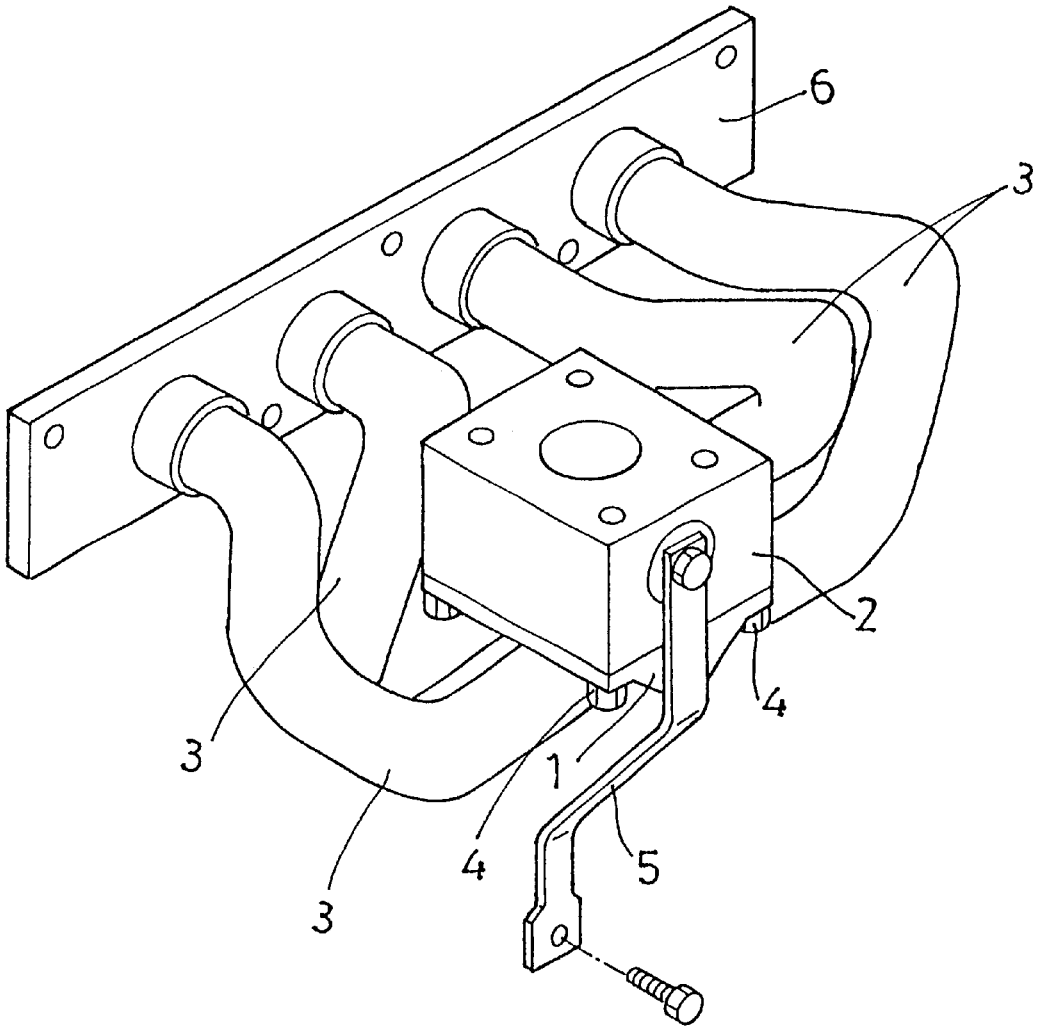
FIG. 3 is a schematic perspective view of an intake manifold according to a second embodiment of the present invention.
Figure 4:
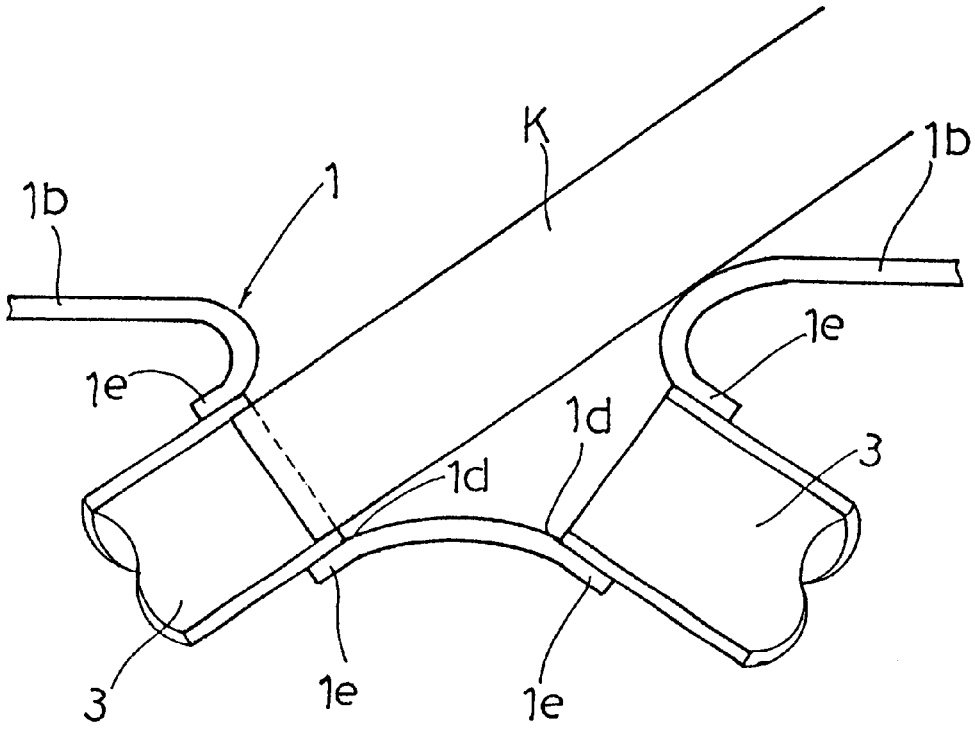
FIG. 4 is an enlarged cross sectional view showing he brazing area where branch tubes are positioned by peen locking to the brazing side member of a surge tank shown in FIG. 3.
Figure 5:
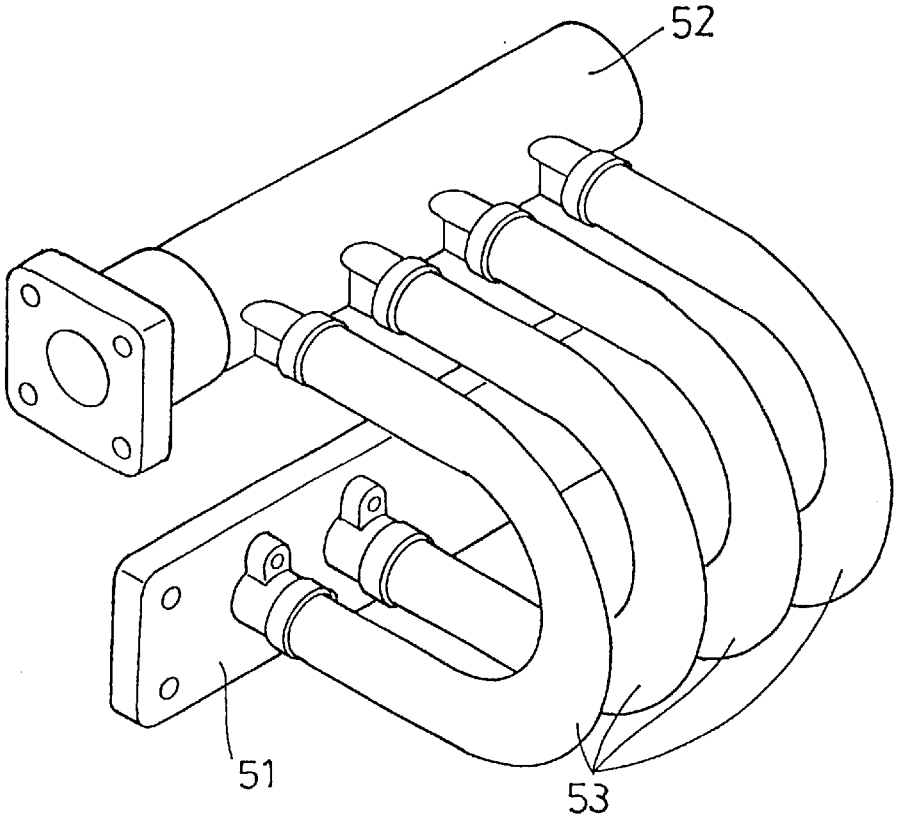
Fig 5 PRIOR ART
FIG. 5 is a schematic perspective view of a conventional intake manifold.
Figure 6:
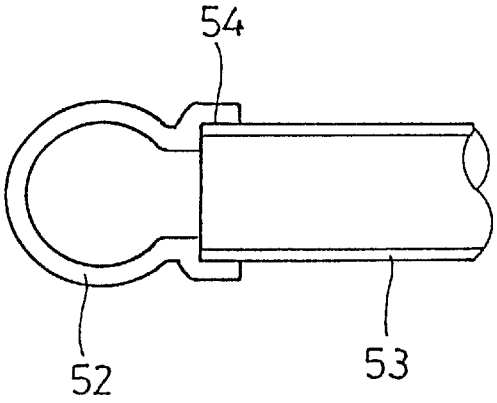
Fig 6 PRIOR ART
FIG. 6 is an enlarged cross sectional view of a conventional brazing area.

A second embodiment of the present invention will now be described with reference to FIG. 3. A brazing side member 1 of a surge tank, to which one end of each of four branch tubes 3 is joined, has an inner wall portion 1*a* with opposite openings 1*d*. A projection 1*e* is formed about each opening 1*d* to project outwardly. One end of each branch tube 3 is peen-locked by using a peening tool K so as to be fixed in position in the projection 1*e*. After positioned by the peen-locking operation, they are placed in a furnace for brazing. Because the brazing operation in the furnace is carried out with no positional discrepancy allowed, a higher degree of air-tightness may be provided.

Similarly, the joining operation of the other end of each of the branch tubes 3 to a flange 6 is made by brazing after positioned by the peen-locking operation using a peening tool K. Accordingly, any positional discrepancy may be eliminated and a higher degree of air-tightness may be ensured.

A separate non-heating member 2 is securely tightened by bolts 4 to the upper side of the brazing side member 1. The non-heating member 2 is neither placed in the furnace nor subjected to the heating process, so that its physical strength can be guaranteed. This will allow a stay 5 or the like to be joined to the non-heating member 2, for example, by a bolt that is screwed into its corresponding female thread provided in the non-heating member 2.

As described above, the stay 5 or the like may be joined to the non-heating side member 2 which is not declined in the physical strength. Therefore, the effect of vibration to an automobile can be reduced when the entire surge tank is mounted on the automobile. Also, the non-heating side member 2 is not subjected to the heating process and can thus be fabricated from a low-melting point aluminum alloy at lower cost.

What is claimed is:

1. An intake manifold having a plurality of branch tubes each joined by brazing in a furnace at one end to a flange on the engine side and at the other end to a surge tank on the throttle chamber side, said surge tank being separated into two pieces; a brazing side member to which the branch tubes are fixed in position by peen locking and are then joined by brazing in the furnace; and a non-heating side member which is not subjected to the brazing operation in the furnace but is joined to the brazing side member by fasteners.

2. An intake manifold according to claim 1, wherein the non-heating side member is reinforced by a stay.

3. An intake manifold having a plurality of branch tubes each joined by brazing in a furnace at one end to a flange on the engine side, said surge tank being separated into two pieces; a brazing side member to which the branch tubes are joined by brazing in the furnace; and a non-heating side member which is not subjected to the brazing operation in the furnace but is joined to the brazing side member by fasteners, the brazing side member being formed of aluminum alloy having a high melting point, and the non-heating side member being formed of aluminum alloy having a low melting point.

4. An intake manifold according to claim 3, wherein the non-heating side member is reinforced by a stay.

* * * * *